US008023879B2

(12) United States Patent
Lee

(10) Patent No.: US 8,023,879 B2
(45) Date of Patent: Sep. 20, 2011

(54) AUTO DOCUMENT FEEDER AND IMAGE FORMING APPARATUS INCLUDING THE SAME

(75) Inventor: Hyun-ho Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 688 days.

(21) Appl. No.: 11/778,338

(22) Filed: Jul. 16, 2007

(65) Prior Publication Data

US 2008/0019747 A1 Jan. 24, 2008

(30) Foreign Application Priority Data

Jul. 19, 2006 (KR) ..... 10-2006-0067675

(51) Int. Cl.
*G03G 15/00* (2006.01)

(52) U.S. Cl. ..... 399/367; 399/365

(58) Field of Classification Search ..... 399/367, 399/365

See application file for complete search history.

(56) References Cited

U.S. PATENT DOCUMENTS

| | | | | |
|---|---|---|---|---|
| 4,707,113 | A * | 11/1987 | Shinbrot et al. | 399/367 |
| 4,990,967 | A * | 2/1991 | Colglazier et al. | 399/364 |
| 5,159,395 | A * | 10/1992 | Farrell et al. | 399/401 |
| 5,385,341 | A * | 1/1995 | Yamada et al. | 271/4.01 |
| 5,918,089 | A * | 6/1999 | Malinich et al. | 399/90 |
| 6,134,417 | A * | 10/2000 | Fukasawa | 399/367 |
| 7,441,763 | B2 * | 10/2008 | Su | 271/10.11 |
| 2004/0141785 | A1 | 7/2004 | Kang | |
| 2004/0240916 | A1 * | 12/2004 | Takata et al. | 399/367 |
| 2005/0006839 | A1 * | 1/2005 | Oomori et al. | 271/241 |
| 2005/0030596 | A1 * | 2/2005 | Chen et al. | 358/474 |
| 2007/0109562 | A1 * | 5/2007 | Nagatani | 358/1.6 |

FOREIGN PATENT DOCUMENTS

| | | |
|---|---|---|
| JP | 2002-370411 | 12/2002 |
| KR | 2000-18941 | 10/2000 |
| KR | 2004-16273 | 2/2004 |

* cited by examiner

*Primary Examiner* — Anthony H. Nguyen

(74) *Attorney, Agent, or Firm* — Staas & Halsey LLP

(57) ABSTRACT

An image forming apparatus includes a roller shaft, a paper-transporting which is coupled to the roller shaft and transports a document, a driving part to supply a rotational driving force to the paper-transporting roller, a driving wheel which is coupled to the roller shaft and rotates along with the roller shaft, and a clutch unit which includes a clutch shaft having an axial line deviated from an axial line of the roller shaft, a transmission wheel connected with the clutch shaft and which transmits the driving force to the driving wheel, and a rotation connecting part to selectively transmit the rotational driving force to the transmission wheel.

23 Claims, 8 Drawing Sheets

AUTO DOCUMENT FEEDER AND IMAGE FORMING APPARATUS INCLUDING THE SAME

CROSS-REFERENCE TO RELATED APPLICATION

This application claims the benefit of Korean Application No. 2006-67675, filed Jul. 19, 2006 in the Korean Intellectual Property Office, the disclosure of which is incorporated herein by reference.

BACKGROUND OF THE INVENTION

1. Field of the Invention

Aspects of the present invention relate to an auto document feeder and an image forming apparatus including the same, and more particularly, to an auto document feeder having a compatible driving module and an image forming apparatus including the same.

2. Description of the Related Art

In general, an auto document feeder is used as a kind of a document feeder, includes a scanning part to scan image data recorded on a document stacked in a document stacking stand, and is applied to apparatuses having an information inputting function, such as a scanner, a facsimile, a multi-functional device, and a photocopier. Auto document feeders are classified as a low speed auto document feeder or a high speed auto document feeder according to the document feeding speed. An auto document feeder includes a driving part to generate a driving force and a driving force generating unit having a driving force switching device to switch the driving force of the driving part in order to selectively feed documents. In conventional auto documents feeders, a one-way gear or a swing gear is used as the driving force switching device for the low speed auto document feeder, and an electronic clutch is used as the driving force switching device for the high speed auto document feeder.

As shown in FIG. 1, a conventional high speed auto document feeder 10 includes a driving motor 30 as a driving force generating device and an electronic clutch 20 as a driving force switching device. A driving force of the driving motor 30 is transmitted to an electronic clutch gear 20*a* via a driving pinion 41 and a transmission gear 42 engaged with the driving motor 30. The electronic clutch 20 transmits the driving force transmitted from the electronic clutch gear 20*a* to a rotating shaft 13 of an auto document feed roller 11 when power is turned on by a controller (not shown). The auto document feed roller 11 and a pickup roller 12, of which the mutual rotating shafts thereof are connected to each other by a pickup gear 32, rotate in the same direction 31*a*, thereby feeding the stacked document.

After the document is fed, the electronic clutch 20 is powered off and the rotating shaft 13 is kept idle. Then a bracket 50 accommodating the auto document feed roller 11 and the pick up roller 12 tends to rotate downward with respect to the rotating shaft 13 as a result of its own weight. A spring 60 connects a frame (not shown) with the bracket 50 and supports the bracket 50 by an elastic force to form a predetermined document stacking space.

However, a one-way gear used with the conventional low speed auto document feeder is not directly connected with the rotating shaft of the auto document feed roller, unlike the electronic clutch 20 which is directly connected to the rotating shaft of the conventional high speed auto document feeder. Instead, the one-way gear has a separate rotating shaft which engages a gear connected with the rotating shaft of the auto document feed roller.

In the high speed auto document feeder, since the electronic clutch 20 is directly connected with the rotating shaft 13 of the auto document feed roller 11, the low and the high speed auto document feeders have rotating shafts of the auto paper feed rollers with mutually different lengths. Also, since the electronic clutch 20 is directly connected with the rotating shaft of the auto paper feed roller, but the one-way gear has a separate rotating shaft, low and high speed auto document feeders are not mutually compatible.

Also, in the case of the high speed auto document feeder 10, it is not easy to detach the bracket 50, for example, after a paper jam, since the electronic clutch 20 is directly connected with the rotating shaft 13 by a power cable. Furthermore, since the elastic member 60 is connected with the bracket 50, it is exceedingly difficult to detach the bracket 50.

SUMMARY OF THE INVENTION

It is therefore an aspect of the invention to provide an auto document feeder which modulates a driving force generating unit of a low speed and a high speed auto document feeder to be mutually compatible and to provide an auto document feeder from which a bracket of an auto document feed roller is detachable, and an image forming apparatus including the same.

Additional aspects and/or advantages of the invention will be set forth in part in the description which follows and, in part, will be obvious from the description, or may be learned by practice of the invention.

The foregoing and/or other aspects of the present invention can be achieved by providing an image forming apparatus including a roller shaft, a paper-transporting which is coupled to the roller shaft and transports a document, a driving part to supply a rotational driving force to the paper-transporting roller, a driving wheel which is coupled to the roller shaft and integrally rotates along with the roller shaft, and a clutch unit which includes a clutch shaft having an axial line deviated from the axial line of the roller shaft, a transmission wheel connected to the clutch shaft and which transmits a driving force to the driving wheel, and a rotation connecting part to selectively transmit the rotational driving force to the transmission wheel.

According to an aspect of the present invention, the image forming apparatus further includes a transmission gear which is disposed between the driving part and the clutch unit and which transmits the rotational driving force supplied by the driving part to the clutch unit.

According to an aspect of the present invention, the clutch unit further includes a power source part to supply power to the rotation connecting part, the rotation connecting part includes a driving transmission wheel which is connected to the driving part and rotates with respect to the clutch shaft and an electromagnet part to electromagnetically connect and integrally rotate the clutch shaft with the driving transmission wheel when the power is supplied by the power source part, and the transmission wheel is coupled to the clutch shaft and rotates along with the clutch shaft.

According to an aspect of the present invention, the roller shaft includes an auto document feeding roller shaft and a feed roller shaft which are aligned in parallel with each other, the paper-transporting roller includes an auto document feeding roller which is coupled to the auto document feeding roller shaft and separates the document and other documents into sheets by using a frictional force generated by a rubber pad which contacts the documents, and a feed roller which is coupled to the feed roller shaft to feed the sheets in a predetermined direction, the driving wheel includes an auto document feeding gear which is connected with the auto document feeding roller shaft, and a feed gear which is connected with the feed roller shaft, and the clutch unit includes a first clutch unit to selectively transmit the rotational driving force supplied by the driving part to the auto document feeding gear, and a second clutch unit to selectively transmit the rotational driving force supplied by the driving part to the feed gear.

According to an aspect of the present invention, the first clutch unit includes an elastic member disposed between the transmission wheel and the driving transmission wheel to prevent a bracket from rotating downward and blocking a predetermined stacking space.

According to an aspect of the present invention, the elastic member is a plate spring and is inserted into the clutch shaft.

The foregoing and/or other aspects of the present invention can be achieved by providing an image forming apparatus, including a driving part to generate a rotational driving force, a main unit which includes a roller shaft, a paper-transporting roller which is coupled to the roller shaft and transports a document, and a driving wheel which is coupled to the roller shaft, a sub unit which is detachably coupled with the main unit and includes a clutch unit having a clutch shaft, a transmission wheel which is connected with the clutch shaft and transmits the rotational driving force to the driving wheel, and a rotation connecting part to selectively transmit the rotational driving force generated by the driving part to the transmission wheel.

According to another aspect of the present invention, the sub unit further includes a sub frame which supports the clutch unit and the driving part is mounted to the sub frame of the sub unit and is detachable from the main unit in integration with the sub unit.

According to another aspect of the present invention, the clutch unit further includes a power source part to supply power to the rotation connecting part, the rotation connecting part includes a driving transmission wheel which is connected with the driving part and rotates with respect to the clutch shaft, and an electromagnet part which rotates both the clutch shaft and the driving transmission wheel when the power is supplied by the power source part, and the transmission wheel is coupled to the clutch shaft.

According to another aspect of the present invention, the paper-transporting roller includes an auto document feeding roller to separate the document and other documents into sheets by using a frictional force generated by a rubber pad which contacts the document and the other documents, and the image forming apparatus further includes a bracket which rotatably supports the auto document feeding roller above a predetermined document stacking space.

According to another aspect of the present invention, the first clutch unit includes an elastic member disposed between the transmission wheel and the driving transmission wheel to prevent the bracket from rotating downward and blocking a predetermined document stacking space.

According to another aspect of the present invention, the elastic member is a plate spring and is inserted into the clutch shaft.

BRIEF DESCRIPTION OF THE DRAWINGS

These above and/or other aspects and advantages of the invention will become apparent and more readily appreciated from the following description of the embodiments, taken in conjunction with the accompanying drawings, in which.

DETAILED DESCRIPTION OF THE EMBODIMENTS

Figure 1:
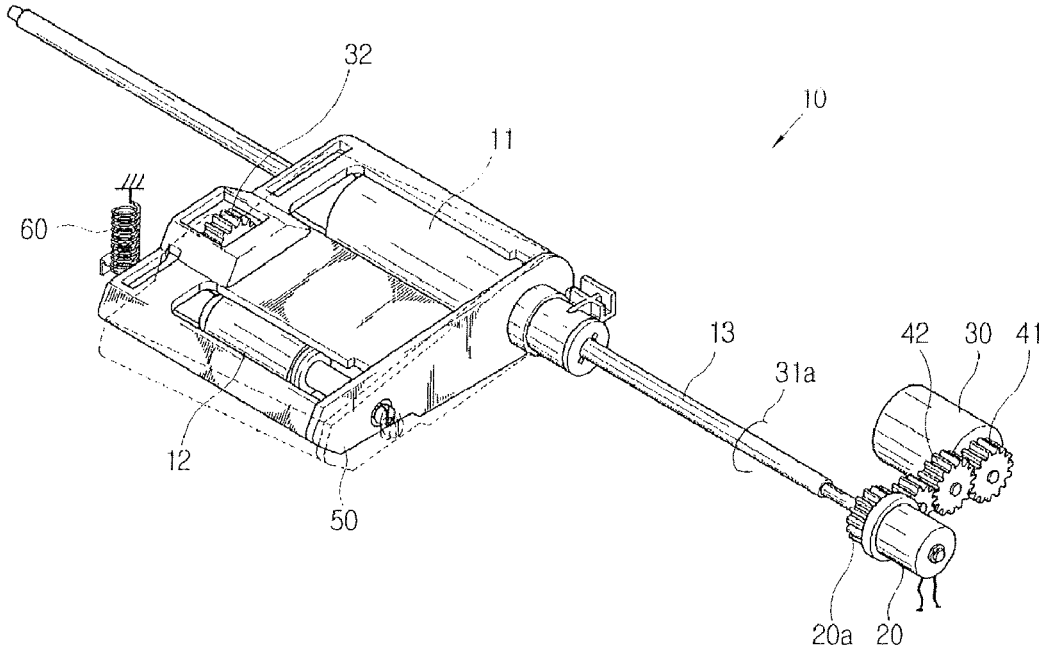
FIG. 1 (RELATED ART)
FIG. 1 is an enlarged view illustrating a main part of a conventional high speed auto document feeder.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The same elements are given the same reference numerals in various embodiments, and they will be typically described in the first embodiment, and will be omitted in the other embodiments.

Figure 2:
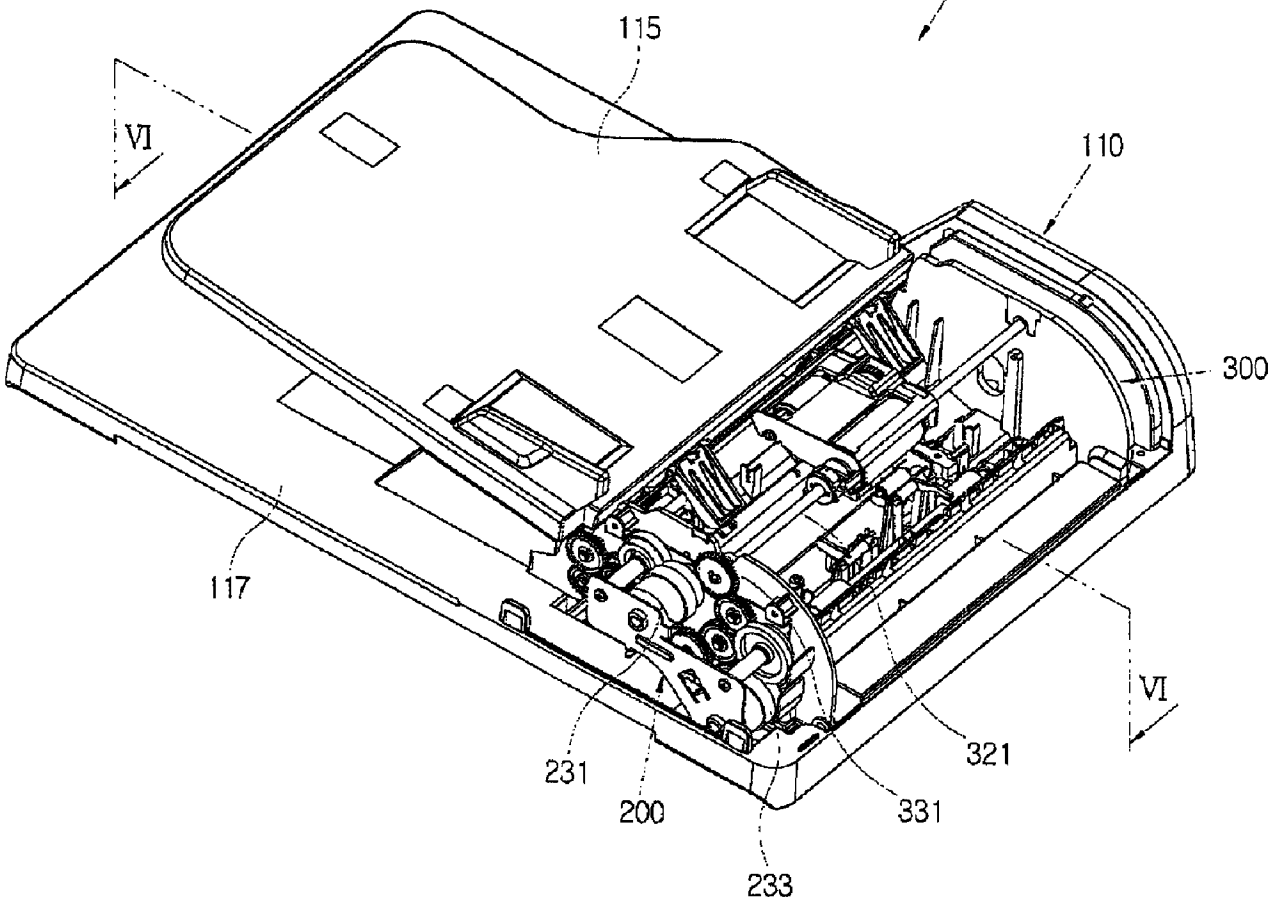
FIG. 2 is a perspective view illustrating an auto document feeder according to an embodiment of the present invention.
Figure 6:
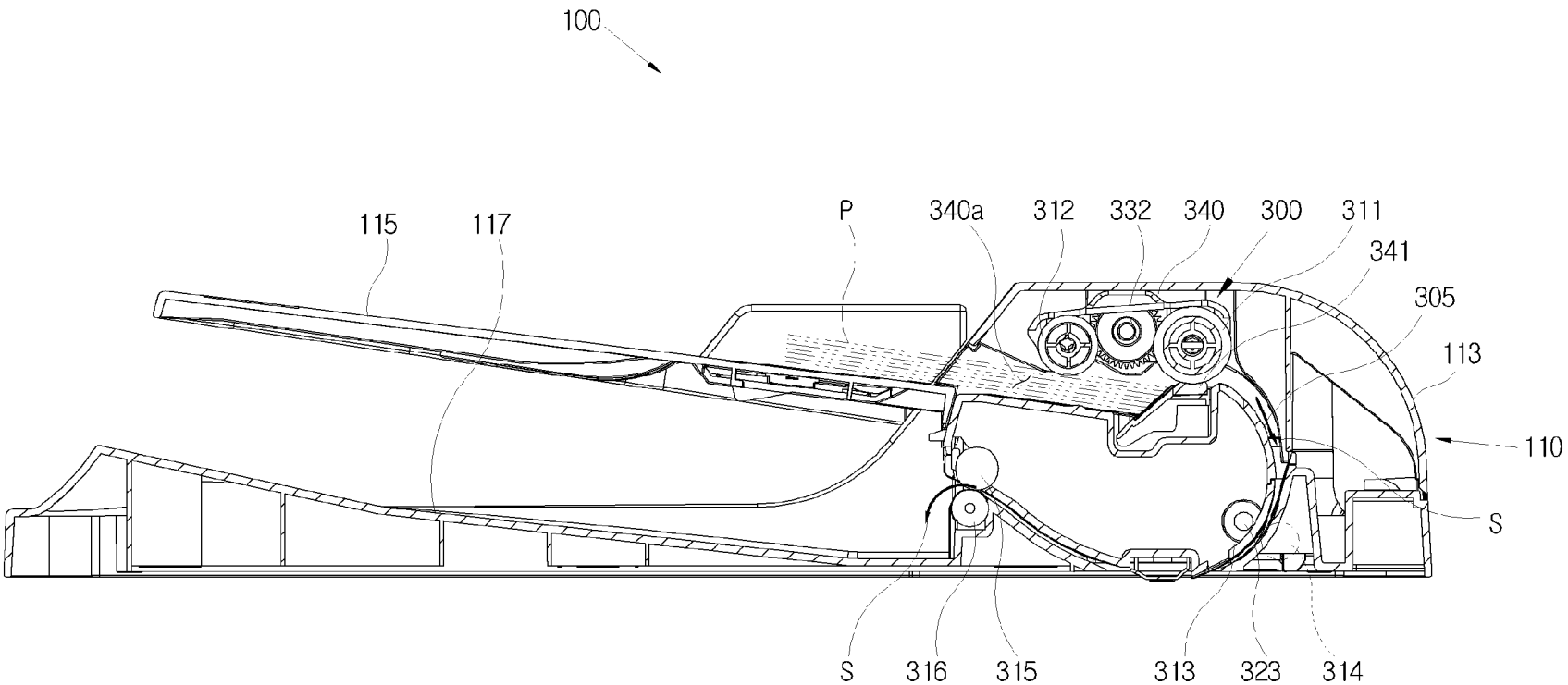
FIG. 6 is a sectional view taken along the line VI-VI in FIG. 2.

Hereinafter, an auto document feeder 100 will be taken as one example of the auto document feeder according to aspects of the present invention. FIG. 2 is a perspective view of the auto document feeder 100 with a casing 113 removed from an exterior case 110, which forms an outer appearance of the auto document feeder 100. As shown in FIGS. 2 and 6, a document P stacked in a document stacking stand 115 is fed along a predetermined feeding path (refer to the S in FIG. 6, which denotes a feeding path in the shape of a letter "C") when feeding rollers 310 of a document feeding part 300 rotate after receiving a driving force. These feeding rollers 310 may also be referred to as "paper-transporting rollers" 310. The document P may be various types of recording media, such as, for example, paper, transparency sheets, etc. After the document P is guided to the feeding path S and image information is scanned by a scanning unit (not shown), the document P is discharged to a document discharging stand 117 by the feeding rollers 310. It is therefore understood that the paper-transporting rollers 310 are not limited to transporting paper, and may instead transport any of the various types of documents P described above.

Figure 3:
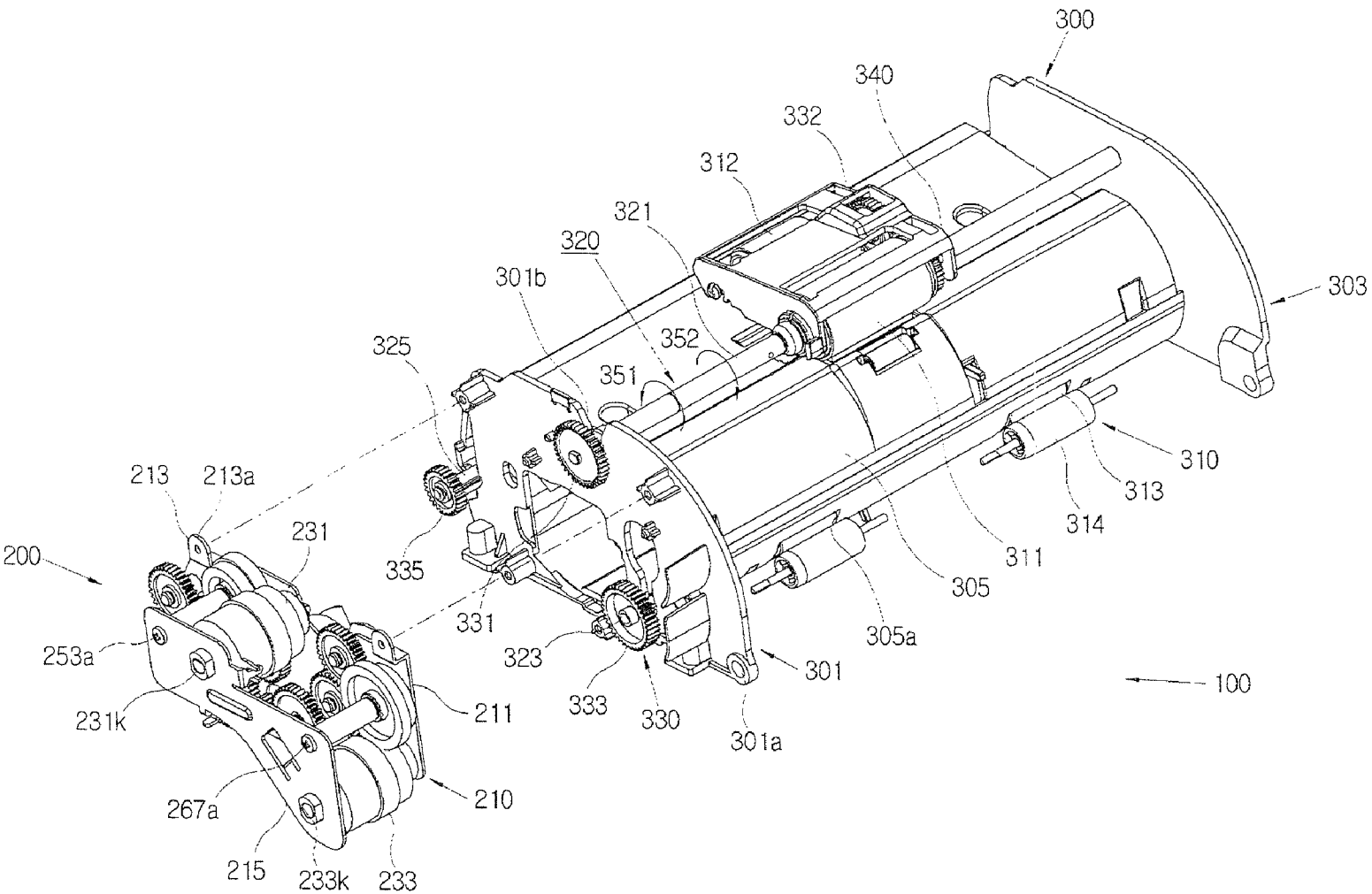
FIG. 3 is an exploded perspective view illustrating a main part of the auto document feeder shown in FIG. 2.

As shown in FIG. 2, the document feeding part 300 embodied as a main unit 300 is accommodated inside the exterior case 110. As shown in FIGS. 3 and 6, the document feeding part 300 comprises side frames 301 and 303 which function as frames supporting the document feeding part 300, a feeding path frame 305 forming the feeding path S, a plurality of feeding rollers 310 to feed the document P, and a driving wheel 330 which integrally rotates with a plurality of rotating shafts 321, 323 and 325 of the feeding rollers 310.

As shown in FIG. 3, the left-side frame 301 rotatably supports the rotating shaft 321 by a supporting groove 301*b* having an open upper side to detach a bracket 340 through which the rotating shaft 321 of an auto document feeding roller 311 passes. The left-side frame 301 has a plurality of coupling holes 301*a* which are coupled with the high speed driving module 200. Preferably, a female screw is threaded into internal circumferences of the coupling holes 301*a*, to simplify the assembly process. However, it is understood that coupling devices other than female screws may be used to couple the left-side frame 301 with the high speed driving module 200.

As shown in FIG. 3, the right-side frame 303 rotatably supports the rotation shaft of the auto document feeding roller 311. As shown in FIGS. 3 and 6, the feeding path frame 305 forms one part of the feeding path of the document fed by the feeding rollers 310, and rotatably accommodates and supports feed rollers 313 and 314 in a feed roller accommodating part 305*a*. The feeding path frame 305 rotatably supports a feed roller shaft 323 and a discharging roller shaft 325.

The side frames 301 and 303 and the feeding path frame 305 are preferably coupled to each other by other known coupling devices, such as screws and/or fasteners. However, the side frames 301 and 303 and the feeding path frame 305 may instead be integrally formed as necessary.

As shown in FIGS. 3 and 6, the feeding rollers 310 include a pickup roller 312 to feed the documents P stacked in the document stacking stand 115, an auto document feeding roller 311 to separate the fed documents P into sheets, and a pair of feed rollers 313 and 314 to align the leading edge of the documents P and to feed the aligned documents P toward discharging rollers 315 and 316. The pair of discharging rollers 315 and 316 discharge the documents P, which have passed through the feed rollers 313 and 314 and scanned by the scanning unit (not shown), to the discharging stand 117.

As shown in FIGS. 3 and 6, the auto document feeding roller 311 and the pick up roller 312 are accommodated by the bracket 340 disposed on the upper part of the feeding path frame 305, and are connected to a pick up gear 332 in such a way to rotate in the same direction as the pick up gear 332 (see 351 in FIG. 3, which denotes counterclockwise). The auto document feeding roller 311 makes contact with a rubber pad 341 which is disposed in the upper part of the feeding path frame 305 and has a predetermined friction coefficient to separate the documents P into sheets.

The feed rollers 313 and 314 include a main feed roller 313 which is disposed in the feed roller shaft 323 and supported by the feeding path frame 305, and an auxiliary feed roller 314 which is rotatably contacted with the main feed roller 313 outside the feeding path frame 305. Preferably, the auto document feeder 100 has the two feed rollers 313 and 314 respectively disposed on opposite sides of the feed roller shaft 323, as shown in FIG. 3. However, the auto document feeder 100 may instead have only one feeding roller. As shown in FIG. 3, the main feed roller 313 rotates due to a driving force generated by a driving module 200 and transmitted to a feed gear 333 connected to one end of the feed roller shaft 323. The auxiliary feed roller 314 rotates in the opposite direction to that of the main feed roller 313 as the main feed roller 313, which is in contact with the auxiliary feed roller 314, rotates.

As shown in FIGS. 3 and 6, the discharging rollers 315 and 316 comprise a main discharging roller 315 which is disposed on the discharging roller shaft 325 and accommodated in the feeding path frame 305, and an auxiliary discharging roller 316 contacted with the main discharging roller 315 outside the feeding path frame 305. As shown in FIG. 6, the main discharging roller 315 rotates due to a driving force generated by the driving module 200 and transmitted to a discharging gear 335 connected with one end of the discharging roller shaft 325. The auxiliary discharging roller 316 rotates in the opposite direction to that of the main discharging roller 315 as the main discharging roller 315, which is in contact with the auxiliary discharging roller 316, rotates.

As shown in FIG. 3, the driving wheel 330 is preferably embodied as a feeding gear 330 which is engaged with the driving module 200 and drives the feeding roller 310 to transmit a reliable driving force and to enhance space efficiency. However, it is understood that the driving wheel 330 is not limited to being embodied as a feeding gear 330. For example, the driving wheel 330 may instead be embodied as a sprocket which is engaged with the driving module 200 by a chain belt to receive a driving force of the driving module 200.

The bracket 340 receives a driving force from the auto document feeding roller shaft 321 to accommodate the auto document feeding roller 311 and the pick up roller 312 mutually rotating in the same direction. Also, the auto document feeding roller 311 and the pick up roller 312 preferably rotate in the same direction due to the pick up gear 332 engaging both rollers 311 and 312. The bracket 340 is preferably attached with the auto document feeding roller shaft 321 of the left-side frame 301 and an auto document feeding gear 331 so that the bracket 340 is detachable from the side frames 301 and 303.

As shown in FIG. 2, the driving module 200 embodied as a sub unit 200 is internally accommodated inside and on one side of the exterior case 110 to transmit the driving force to the feeding gears 330, 331, 333, and 335 of the document feeding part 300.

As shown in FIG. 3, the driving module 200 comprises internal and an external supporting frames 211 and 215, a driving part 220 to generate a driving force, a clutch unit 230 to selectively transmit the driving force of the driving part 220 to the feeding gear 330, and transmission gears 250, 260, and 270 disposed between the clutch unit 230 and the driving part 220 for intermediate transmission of the driving force. The clutch unit 230 in the sub unit 200 may be operated by various forces. For example, the sub unit 200 may be a first type of which the clutch unit 230 is operated by electric power, or a second type of which the clutch unit 230 is operable without electric power.

The driving module 200 is preferably coupled with the document feeding part 300 by a coupling device which extends through a plurality of through holes 213*a* disposed in a projection part 213 of the internal supporting frame 211 and the coupling holes 301*a* of the left-side frame 301, as shown in FIG. 3. However, the coupling method to couple the driving module 200 and the document feeding part 300 is not limited to this method, and may instead be coupled by other known coupling methods, such as, for example, adhesive coupling, press-fitted coupling, or hitching groove coupling.

The driving part 220 comprises a driving motor (not shown) to generate a rotation driving force and a driving motor pinion 223 to integrally rotate with the rotating shaft of the driving motor. The driving motor pinion 223 is engaged with a reduction gear 241 to transmit the driving force to the reduction gear 241.

Figure 4A:
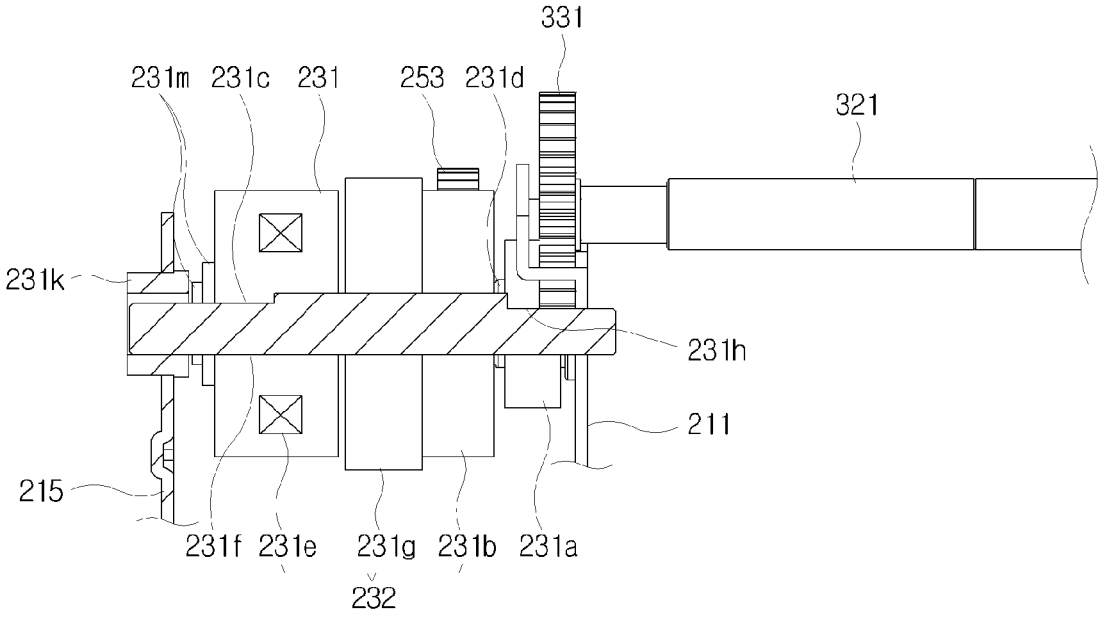
FIGS. 4A and 4B are enlarged sectional views illustrating a main part of an operating process of the first clutch unit shown in FIG. 2.
Figure 4B:
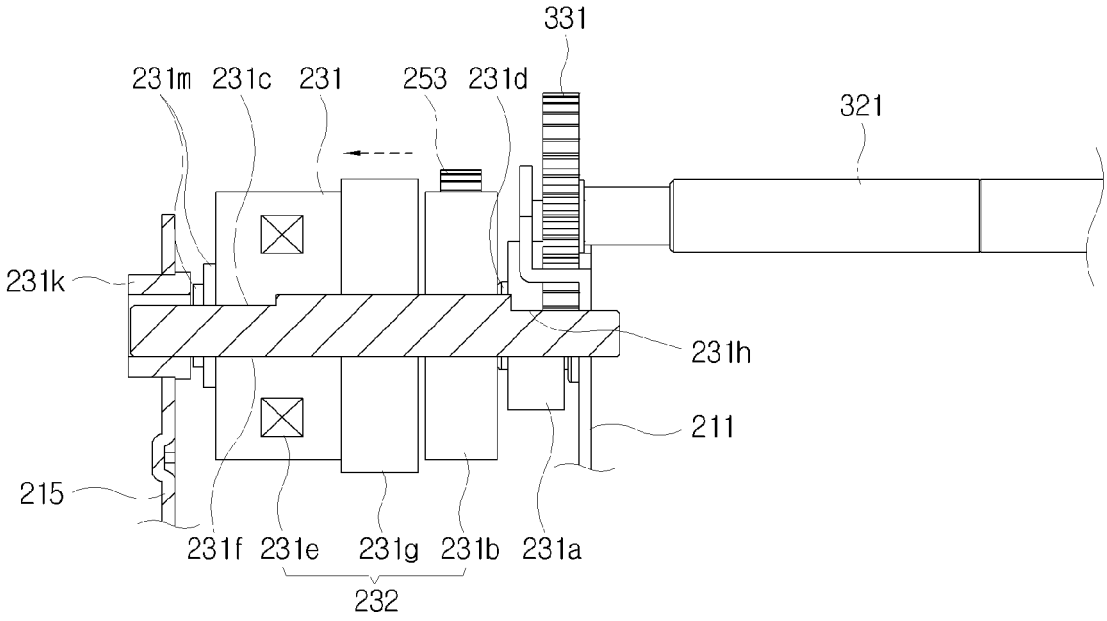

As shown in FIGS. 2, 4A and 4B, the clutch unit 230 comprises a clutch shaft 231*f* which is not directly connected to the feeding roller shafts 321 and 323 but is instead deviated from the feeding roller shafts 321 and 323, and a rotation connecting part 232 to selectively transmit the rotating driving force generated by the driving part 220 to the auto document feeding gear 331 and the feed gear 333 on the auto feeding roller shaft 321 and the feed roller shaft 323. Accordingly, the driving force of the feeding roller shafts 321 and 323 is selectively transmitted and the independent driving module 200 separated from the document feeding part 300 may be formed. Also, the bracket 340 of the document feeding part 300 may be easily extracted from the auto document feeder 100 to the outside when a document P is jammed by using the driving module 200 having the configuration described below.

Figure 5:
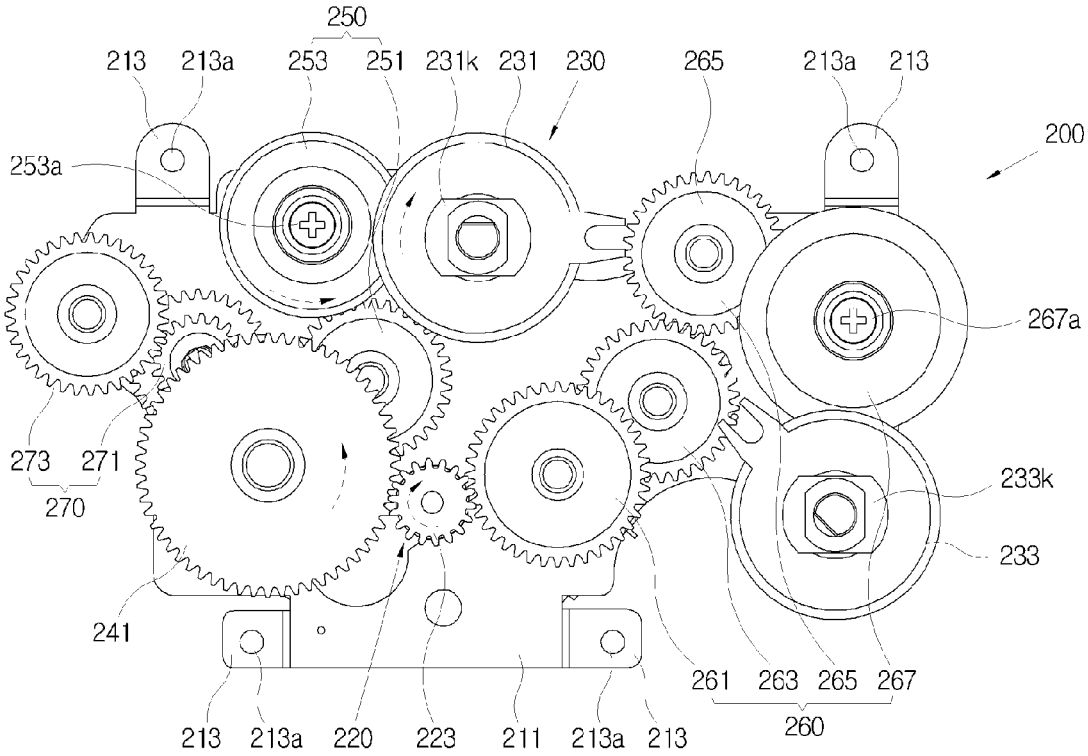
FIG. 5 is an enlarged view illustrating the driving module of the auto document feeder shown in FIG. 2.

FIG. 5 is a front view of the driving module 200 of which the external supporting frame 215 is removed. As shown in FIGS. 3 and 5, the clutch unit 230 comprises a first clutch unit 231 to selectively transmit the rotating driving force generated by the driving part 220 to the auto document feeding roller 311, and a second clutch unit 233 to selectively rotate the feed roller 313 so as to align the leading edge of the documents P fed by the auto document feeding roller 311.

As shown in FIGS. 4A and 4B, the first clutch unit 231 includes the clutch shaft 231*f* having an axial line deviated from that of the auto document feeding roller shaft 321, a transmission wheel 231*a* which is connected with the clutch shaft 231*f* to transmit a driving force to the auto document feeding gear 331, and the rotation connecting part 232 to selectively transmit the rotating driving force to the transmission wheel 231*a*. The first clutch unit 231 preferably also includes a power source part (not shown) to supply power to the rotation connecting part 232 as necessary.

The clutch shaft 231*f* is rotatably supported on the supporting frames 211 and 215 by a bushing 231*k*. Also, a washer 231*m* is inserted between the bushing 231*k* and the rotation connecting part 232. Preferably, a D-cut part 231*h* and a groove corresponding thereto are formed on one end of the clutch shaft 231*f* and in the center of the transmission wheel 231*a* to be integrally rotated with each other. However, it is understood that other known washer devices may be used to integrally rotate the clutch shaft 231*f* and the transmission wheel 231*a*. Preferably, the transmission wheel 231*a* is embodied as a gear to enhance space efficiency and reliably transmit the driving force generated by the driving part 220.

As shown in FIGS. 4A and 4B, the rotation connecting part 232 includes a driving transmission wheel 231*b* which receives a driving force from the driving part 220 to rotate with respect to the clutch shaft 231*f*, and electromagnet parts 231*e* and 231*g* which enable the clutch shaft 231*f* and the driving transmission wheel 231*b* to be integrally rotated with each other by an electromagnetic attraction supplied with power generated by the power source part (not shown). The driving transmission wheel 231*b* receives the rotation driving force of the driving part 220 which is engaged with a transmitting gear 253. Between the driving transmission wheel 231*b* and the electromagnet parts 231*e* and 231*g* exists a minute interval so that the driving transmission wheel 231*b* can rotate in an idle state when the driving force does not need to be transmitted to the auto document feeding gear 331.

As shown in FIGS. 4A and 4B, the electromagnet parts 231*e* and 231*g* include a rotation connecting wheel 231*g* which integrally rotates with the clutch shaft 231*f* when power is supplied to the rotation connecting part 232, and an electromagnet 231*e* which slightly moves the rotation connecting wheel 231*g* toward the driving transmission wheel 231*b* to enable the wheels 231*g* and 321*b* to integrally rotate with each other. The clutch shaft 231*f* and the rotation connecting wheel 231*g* are configured to have key grooves corresponding to each other, and may be integrally rotated by inserting a key into the key grooves. It is understood that connecting devices other than key grooves may be used to integrally rotate the clutch shaft 231*f* and the rotation connecting wheel 2331*g*. Also, a separated projection is disposed on an internal circumference of the rotation connecting wheel 231*g*, and a projection is disposed on an external circumference of the clutch shaft 231*f* engaged thereto to be integrally rotated. Alternatively, the rotation connecting wheel 231*g* and the clutch shaft 231*f* may be integrally rotated by other known coupling devices. The electromagnet 231*e* may be coupled to a D-cut part 231*c* to be integrally rotated with the clutch shaft 231*f* as necessary.

As shown in FIGS. 4A and 4B, the first clutch unit 231 further includes an elastic member 231*d* disposed between the driving transmission wheel 231*b* and the transmission wheel 231*a*. The elastic member 231*d* prevents the bracket 340 from rotating downward with respect to the auto document feeding roller shaft 321 when the first clutch unit 231 is powered off. The elastic member 231*d* elastically presses against one side of the transmission wheel 231*a*. Preferably, the elastic member 231*d* is shaped to fit on the clutch shaft 231*f* in such a way to maximize the assembling efficiency of the clutch shaft 231*f*. Also, the elastic member 231*d* is preferably embodied as a plate spring which has a large area that contacts the transmission wheel 231*a*. In addition, other known elastic members, such as a rubber pad may instead be used as the elastic member 231*d*.

Accordingly, the transmission wheel 231*a* is not rotated by a frictional force generated between the elastic member 231*d* and the transmission wheel 231*a* which blocks the rotation of the bracket 340 when the first clutch unit 231 is powered off. The frictional force generated between the elastic member 231*d* and the transmission wheel 231*a* must be generated to block the rotation of the bracket 340, but must not interfere with the rotation of the driving transmission wheel 231*a*.

As shown in FIG. 6, the elastic member 231*d* prevents the bracket 340 from closing a predetermined document stacking space 340*a* by rotating downward when documents P are not left in the document stacking stand 115 to hold the bracket 340 up. Thus, the bracket 340 is detachable, and the rotation of the bracket 340 down into the predetermined document stacking space 340*a* can be blocked at the same time. Accordingly, using the elastic member 231*d* solves the above-described problem with the conventional auto document feeder 10 which employs a spring 60 (see FIG. 1) to block the rotation of the bracket, namely, that the bracket is exceedingly difficult to disassemble.

As shown in FIG. 4A, when the power source part of the first clutch unit 231 is supplied with power, the rotation connecting wheel 231*g* engages and integrally rotates with the driving transmission wheel 231*b* as a result of electromagnetic force generated by the electromagnet 231*e*. When the rotation connecting wheel 231*g* engages and integrally rotates with the driving transmission wheel 231*b*, the clutch shaft 231*f* coupled to the rotation connecting wheel 231*g* also rotates. Also, the transmission wheel 231*a*, which is coupled to the D-cut part 231*h* formed on one side of the clutch shaft 231*f*, rotates with the clutch shaft 231*f*. Accordingly, the driving force of the driving transmission wheel 231*b* is transmitted to the transmission wheel 231*a*.

As shown in FIG. 4B, when power is blocked in the power source part of the first clutch unit 231, the rotation connecting wheel 231*g* and the driving transmission wheel 231*b* are separated at a slight interval, and the driving transmission wheel 231*b* rotates in an idle state. Therefore, the driving force of the driving transmission wheel 231*b* is not transmitted to the transmission wheel 231*a*. That is, the first clutch unit 231 transmits the driving force generated by the driving part 220 to the transmission wheel 231*a* and rotates the auto document feeding gear 331 connected with the transmission wheel 231*a* only when power is applied.

The second clutch unit 233 is preferably designed to have one of the same configurations as the above-described configurations of the first clutch unit 231, except that the second clutch unit 233 does not have the elastic member 231*d*. As shown in FIG. 3, the clutch shaft (not shown) of the second clutch unit 233 is rotatably supported in the supporting frames 211 and 215 by a bushing 233*k*. The transmission wheel (not shown) of the second clutch unit 233 is engaged with the feed gear 333, and the driving transmission wheel (not shown) is engaged with a transmission gear 267 to transmit the driving force generated by the driving part 220. The second clutch unit 233 also transmits the driving force to the feed gear 333 only when power is applied. The first clutch unit 231 and/or the second clutch unit 233 may be embodied as either a one-way gear or a swing gear in consideration of manufacturing costs. Additionally, it is understood that the first clutch unit 231 and the second clutch unit 233 are not limited to being embodied as one-way gears or swing gears, and may instead be embodied as other types of gears commonly known in the art.

The clutch unit 230 may be designed to have many different configurations, as long as selective transmission of the rotation driving force of the driving transmission wheel 231*b* depends on whether power is supplied from the power source part of the clutch unit 230 shown in FIG. 4.

As shown in FIGS. 3 and 5, the reduction gear 241 is engaged with the driving pinion 223 to simultaneously transmit a driving force to the transmission gear 250, which is engaged with the auto document feeding gear 331, and to the transmission gear 270, which is engaged with the discharging gear 335.

The transmission gears 250, 260, and 270 are rotatably supported in the supporting frames 211 and 215 by a fastening device (not shown), such as a stud, a hook, etc. As shown in FIG. 5, a first transmission gear 250 is disposed between the driving pinion 223 and the driving transmission wheel 231*b* of the first clutch unit 231 to transmit a driving force to the first clutch unit 231. The transmission gear 253 is inserted into the internal supporting frame 211 having the stud and couples a coupling device 253*a* disposed on the upper surface of the external supporting frame 215, thereby mutually coupling the internal and the external supporting frames 211 and 215 together. The coupling device 253*a* is preferably, but not necessarily, a screw.

A second transmission gear 260, as shown in FIG. 5, is disposed between the driving pinion 223 and the driving transmission wheel of the second clutch unit 233 to transmit a driving force to the second clutch unit 233. The internal and the external supporting frames 211 and 215 are coupled by another coupling device 267*a* similar to the coupling device 253*a*. A third transmission gear 270 is disposed between the reduction gear 241 and the discharging roller gear 335 to transmit the rotational driving force generated by the driving part 220 to the discharging roller gear 335.

As shown in FIG. 6, the auto document feeding roller 311 needs to rotate counterclockwise (see the arrow indicated by 351 in FIG. 3) to feed a document P, whereas a main feed roller 313 and a main discharging roller 315 must rotate clockwise (see the arrow indicated by 352 in FIG. 3). Accordingly, the transmission gears 250, 260, and 270 should each have a proper gear combination so that the entire process beginning with feeding the document P and ending with discharging the document P can be performed by rotating the driving motor in a regular direction in consideration of the rotating direction of the driving motor. For example, if the driving motor regularly normal-rotates (see the arrow pointing clockwise in FIG. 5), the first and the third transmission gears 250 and 270 should have an even number of gears, such as two gears, and the second transmission gear 260 should also have an even number of gears, such as four gears. In contrast, if the driving motor regularly counter-rotates, the transmission gears 250, 260, and 270 should have gear combinations having odd numbers of gears.

Figure 7:
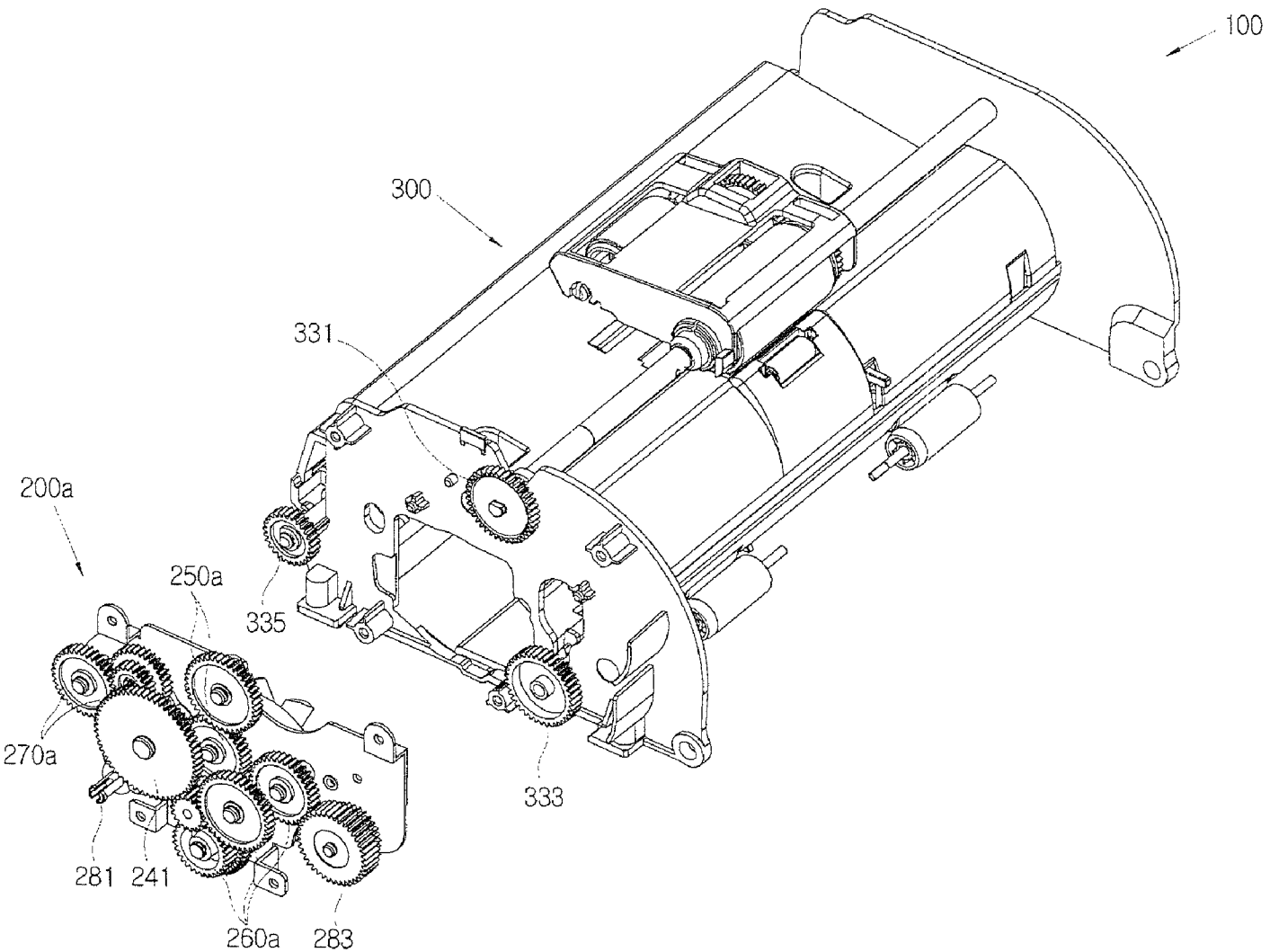
FIG. 7 is an exploded perspective view of the auto document feeder shown in FIG. 2 in which a low speed driving module is used.

As shown in FIG. 7, the auto document feeder 100 may have a low speed driving module 200*a* as another sub unit in place of the driving module 200. That is, the driving modules 200 and 200*a* of the auto document feeder 100 may be easily exchanged with each other depending on whether a user desires a high or low operational speed, and at the same time the other components of the auto document feeder 100 may be shared, thereby lowering a manufacturing cost and enhancing an assembling efficiency. A swing gear 281 and a one-way gear 283 are used in the low speed driving module 200*a* instead of the first clutch unit 231 and the second clutch unit 233 of the driving module 200. The driving module 200 connects the driving force by turning on or off power of the electronic clutch 230, whereas the low speed driving module 200*a* can selectively transmit the driving force by normal-rotating or counter-rotating the driving motor of the driving part 220. As shown in FIG. 7, the low speed driving module 200*a* may include transmission gears 250*a*, 260*a*, and 270*a* configured with the proper numbers of gears, in the same way that the above-described transmission gears 250, 260, and 270 of the driving module 200 are configured. Also, the description of the operation process from feeding documents to discharging documents P will be omitted as the operation process is a known technology.

The auto document feeder 100 according to aspects of the present invention may further include a document sensor (not shown) to detect whether documents P exist on the document stacking stand 115, a position sensor (not shown) which is disposed on the document feeding path (see S in FIG. 6), preferably between the auto document feeding roller 311 and the feed rollers 313 and 314, to detect the position of the document P, and a controller to turn on or off the power of the clutch unit 230 according to the position of the document P detected by the above-described sensors.

An image forming apparatus (not shown) according to aspects of the present invention may include the above-described auto document feeder 100, and a scanning unit (not shown) to scan image data of the document P passing through a predetermined path of the auto document feeder 100. The scanning unit is preferably, but not necessarily, a CIS (Contact Image Sensor) or a CCD (Charged Coupled Device). The image forming apparatus may be embodied as a scanner which scans image data of the document P through the scanning unit to store the shape of the image information data, or a photocopier, a facsimile, or a multi-functional device which scans image data of the document P to copy the data on the recording medium.

Hereinafter, an operation process of the image forming apparatus including the auto document feeder 100 with the above-described configuration according to aspects of the present invention will be described.

As shown in FIGS. 5 and 6, when a user wants to automatically feed a document P, the controller applies power to the driving part 220 and normal-rotates the driving motor (see the arrow pointing clockwise in FIG. 5). When the driving pinion 223 integrally rotating with the driving motor normal-rotates, the driving transmission wheel 231*b* of the first clutch unit 231 rotates clockwise via the reduction gear 241 and transmission gears 251 and 253. When the controller applies power to the first clutch unit 231, the transmission wheel 231*a* of the first clutch unit 231 rotates clockwise in integration with the driving transmission wheel 231*b*. The auto document feeding gear 331 engaged with the transmission wheel 231*a* rotates counterclockwise (refer to 351 in FIG. 3), and the auto document feeding roller shaft 321 and the auto document feeding roller 311 rotate in integration with the auto document feeding gear 331. At this time, the document P on the paper stacking stand 115 is fed by the pick up roller 312 which rotates in the same direction as the auto document feeding roller 311. Then, the fed document P is separated into sheets by the auto document feeding roller 311 and the rubber pad 341 to be transmitted toward the feed rollers 313 and 314.

When the document P moving toward the feed rollers 313 and 314 is detected by the position sensor, the controller keeps power of the second clutch unit 233 turned off. Then the feed rollers 313 and 314 remain idle. Also, power is supplied to the first clutch unit 231 for a predetermined time so that the leading edge of the document P fed by the auto document feeding roller 311 can be aligned by the idle feed rollers 313 and 314. The predetermined power supplying time for the first clutch unit 231 is determined based on the distance between the position sensor and the feed rollers 313 and 314.

After the leading edge of the document P is aligned, the controller supplies power to the second clutch unit 233 and controls the feed gear 333 and the main feed roller 313 to rotate clockwise. The the feed rollers 313 and 314, which contact each other, then rotate and transmit the document P toward the discharging rollers 315 and 316. The image information of the fed document P is scanned by the scanning unit (not shown). The scanned image information is copied onto a printing paper and/or stored as image data, depending on a user preference. After the document P is scanned by the scanning unit, the discharging gear 335 and the main discharging roller roller 315 rotate clockwise, and accordingly, the document P is discharged to the discharging stand 117 by the discharging rollers 315 and 316, which rotate in contact with each other. According to an aspect of the invention, no driving force switching unit, such as the clutch unit 230, is disposed between the discharging gear 335 and the driving pinion 223, so the main discharging roller 315 continuously rotates clockwise while the driving motor is operating. However, it is understood that a driving force switching unit may be installed between the discharging gear 335 and the driving pinion 223.

The controller supplies power to the first clutch unit 231 and feeds the document P stacked on the document stacking stand 115 by using the position sensor and the time sensed by the position sensor to improve the document feeding speed in case plural documents P need to be automatically fed while the document P remains on the feeding path. That is, the feeding speed of the document P can be improved by properly controlling the time that the clutch unit 230 is turned on or off. The proper timing control is determined through an experiment or through experience, and the description of the determining method will be omitted, as it is a known technology.

When it is detected by the paper sensor that the documents P which should be automatically fed in the document stacking stand 115 have all been fed and there are no documents P left to feed, the controller controls the driving motor to be counter-rotated (see the counter-clockwise direction in FIG. 5), and supplies power to the first clutch unit 231. When power is supplied to the first clutch unit 231, the auto document feeding gear 331 connected with the driving transmission wheel 231*a* rotates clockwise (refer to 352 in FIG. 3), and accordingly, the auto document feeding roller shaft 321 and the bracket 340 rotating in integration with the auto document feeding gear 331 rotate clockwise. As shown in FIG. 6, when the bracket 340 rotates clockwise with respect to the auto document feeding roller shaft 321, the predetermined document stacking space 340*a* remains open between the feeding path frame 305 and the bracket 340. After that, when the controller cuts off power supplied to the first clutch unit 231, the bracket 340 is prevented from rotating counterclockwise with respect to the auto document feeding roller shaft 321 by the elastic member 231*d* of the first clutch unit 231, and accordingly, the document stacking space 340*a* is kept open.

So far, the process of the auto document feeder 100 feeding and discharging documents P, and the image forming apparatus performing the same process, have been described above. However, aspects of the present invention are not limited thereto, but may also be applied in various other ways, such as to a paper feeder which feeds a printing paper with the same configuration as the auto document feeder 100, or to an inkjet printer or a laser printer with this configuration which sprays ink or toner on the transmitted printing paper to form an image thereon.

As described above, the auto document feeder 100 and the image forming apparatus including the same according to aspects of the present invention have the following beneficial effects.

First, driving force generating units of low speed and the high speed auto document feeders are modulated to be mutually compatible. Accordingly, the low speed and the high speed auto document feeders may have the same configurations except for the driving module, thereby lowering a manufacturing cost and enhancing an assembling efficiency.

Second, in the case that the document P is jammed during an auto feeding process of the document P, the bracket is easily extracted from the auto document feeder to the outside of the image forming apparatus, thereby improving convenience for a user.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

a roller shaft;

a paper-transporting roller which is coupled to the roller shaft and transports a document;

a driving wheel which is coupled to the roller shaft and rotates along with the roller shaft;

a main frame to support the roller shaft and the paper-transporting roller and the driving wheel; and one of a high speed driving module and a low speed driving module to supply a rotational driving force to the paper transporting roller and detachably coupled to the main frame, wherein the high speed driving module comprises a driving part to generate the rotational driving force and a clutch unit having a clutch shaft having an axial line deviated from an axial line of the roller shaft, a transmission wheel connected to the clutch shaft and which transmits the rotational driving force to the driving wheel, and a rotation connecting part to selectively transmit the rotational driving force to the transmission wheel, and wherein the low speed driving module comprises a driving part to generate the rotational driving force, a transmission gear to transmit the rotational driving force to the driving wheel and a one-way gear to selectively transmit the rotational driving force from the driving part to the transmission gear, wherein both the high and the low speed driving modules are compatibly coupled to the main frame such that one of the high and the low speed driving modules can be replaced with the other of the high and the low speed driving modules.

2. The image forming apparatus according to claim 1, further comprising a transmission gear which is disposed between the driving part and the clutch unit and which transmits the rotational driving force supplied by the driving part to the clutch unit.

3. The image forming apparatus according to claim 1, wherein the clutch unit further comprises a power source part to supply power to the rotation connecting part.

4. The image forming apparatus according to claim 3, wherein the rotation connecting part comprises:

a driving transmission wheel which is connected to the driving part and rotates with respect to the clutch shaft; and an electromagnet part to electromagnetically connect and integrally rotate the clutch shaft with the driving transmission wheel when the power is supplied by the power source part.

5. The image forming apparatus according to claim 4, wherein the transmission wheel is coupled to the clutch shaft and rotates along with the clutch shaft.

6. The image forming apparatus according to claim 5, wherein the roller shaft comprises an auto document feeding roller shaft and a feed roller shaft aligned in parallel with each other.

7. The image forming apparatus according to claim 6, wherein the paper-transporting roller comprises:

an auto document feeding roller which is coupled to the auto document feeding roller shaft and separates the document and other documents into sheets by using a frictional force generated by a rubber pad which contacts the documents; and a feed roller which is coupled to the feed roller shaft to feed the sheets in a predetermined direction.

8. The image forming apparatus according to claim 7, wherein the driving wheel comprises:

an auto document feeding gear which is connected with the auto document feeding roller shaft; and a feed gear which is connected with the feed roller shaft.

9. The image forming apparatus according to claim 8, wherein the clutch unit comprises:

a first clutch unit to selectively transmit the rotational driving force supplied by the driving part to the auto document feeding gear; and a second clutch unit to selectively transmit the rotational driving force supplied by the driving part to the feed gear.

10. The image forming apparatus according to claim 9, further comprising a bracket which rotatably supports the auto document feeding roller above a predetermined document stacking space.

11. The image forming apparatus according to claim 10, wherein the first clutch unit comprises an elastic member disposed between the transmission wheel and the driving transmission wheel to prevent the bracket from rotating downward and blocking the predetermined document stacking space.

12. The image forming apparatus according to claim 11, wherein the elastic member is a plate spring and is inserted into the clutch shaft.

13. An image forming apparatus, comprising:

a main unit which includes a roller shaft, a paper-transporting roller which is coupled to the roller shaft and transports a document, and a driving wheel which is coupled to the roller shaft; and a sub unit comprising one of a high speed driving module and a low speed driving module to supply a rotational driving force to the paper-transporting roller and which is detachably coupled with the main unit, wherein the high speed driving module comprises a driving part to generate the rotational driving force and a clutch unit having a clutch shaft, a transmission wheel which is connected with the clutch shaft and transmits the rotational driving force to the driving wheel, and a rotation connecting part to selectively transmit the rotational driving force generated by the driving part to the transmission wheel, and wherein the low speed driving module comprises a driving part to generate the rotational driving force, a transmission gear to transmit the rotational driving force to the driving wheel and a one-way gear to selectively transmit the rotational driving force from the driving part to the transmission gear, wherein both the high and the low speed driving modules are compatibly coupled to the main frame such that one of the high and the low speed driving modules can be replaced with the other of the high and the low speed driving modules.

14. The image forming apparatus according to claim 13, wherein the clutch shaft has an axial line deviated from an axial line of the roller shaft.

15. The image forming apparatus according to claim 13, wherein the sub unit is one of a first sub unit of which the clutch unit is operated by electric power and a second sub unit of which the clutch unit is operable without electric power.

16. The image forming apparatus according to claim 13, wherein the sub unit further comprises a sub frame which supports the clutch unit and the driving part is mounted to the sub frame of the sub unit and is detachable from the main unit in integration with the sub unit.

17. The image forming apparatus according to claim 13, wherein the clutch unit further comprises a power source part to supply power to the rotation connecting part, the rotation connecting part comprises a driving transmission wheel which is connected with the driving part and rotates with respect to the clutch shaft, and an electromagnet part which rotates both the clutch shaft and the driving transmission wheel when the power is supplied by the power source part, and the transmission wheel is coupled to the clutch shaft.

18. The image forming apparatus according to claim 17, wherein the paper-transporting roller comprises an auto document feeding roller to separate the document and other documents into sheets by using a frictional force generated by a rubber pad which contacts the document and the other documents, and the image forming apparatus further comprises a bracket which rotatably supports the auto document feeding roller above a predetermined document stacking space.

19. The image forming apparatus according to claim 18, wherein the clutch unit comprises an elastic member disposed between the transmission wheel and the driving transmission wheel to prevent the bracket from rotating downward and blocking the predetermined document stacking space.

20. The image forming apparatus according to claim 19, wherein the elastic member is a plate spring and is inserted into the clutch shaft.

21. An auto document feeder, comprising:

a paper-transporting roller to feed a document along a predetermined path; and one of a high speed driving module and a low speed driving module to supply a rotational driving force to the paper-transporting roller, wherein the high speed driving module comprises a driving part to generate a rotational driving force which rotates the paper-transporting roller and a clutch unit having a rotation connecting part of which an axial line thereof is deviated from an axial line of the paper-transporting roller, and which electromagnetically connects the driving part to the paper-transporting roller, wherein the low speed driving module comprises a driving part to generate the rotational driving force, a transmission gear to transmit the rotational driving force to the driving wheel and a one-way gear to selectively transmit the rotational driving force from the driving part to the transmission gear, wherein both the high and the low speed driving modules are compatibly coupled to the main frame such that one of the high and the low speed driving modules can be replaced with the other of the high and the low speed driving modules.

22. The auto document feeder of claim 21, further comprising:

a roller shaft having an axial line and to which the paper-transporting roller is coupled; and a driving wheel which is coupled to the roller shaft and rotates along with the roller shaft, wherein the high speed driving module comprises:

a clutch shaft which is disposed along the axial line of the rotation connecting part; and a transmission wheel connected to the clutch shaft which transmits the rotational driving force to the driving wheel and the rotation connecting part comprises a driving transmission wheel which is connected to the driving part and rotates with respect to the clutch shaft.

23. The auto document feeder of claim 22, further comprising:

a bracket which rotatably supports the paper-transporting roller above a predetermined document stacking space; and an elastic member disposed between the transmission wheel and the driving transmission wheel to prevent the bracket from rotating downward and blocking the predetermined document stacking space.

* * * * *